United States Patent [19]

Igel et al.

[11] 4,155,215

[45] May 22, 1979

[54] AUTOMATIC THREADING DEVICE FOR FILAMENT WINDING MACHINES

[75] Inventors: Wolfgang Igel, Ebersbach; Helmut Weiss, Göppingen-Bartenbach, both of Fed. Rep. of Germany

[73] Assignee: Zinser Textilmaschinen GmbH, Ebersbach, Fed. Rep. of Germany

[21] Appl. No.: 875,077

[22] Filed: Feb. 3, 1978

[30] Foreign Application Priority Data

Mar. 28, 1977 [DE] Fed. Rep. of Germany ..... 2713624

[51] Int. Cl.[2] ..... D01H 15/00

[52] U.S. Cl. ..... 57/262

[58] Field of Search ..... 57/34 R, 75, 80

[56] References Cited

U.S. PATENT DOCUMENTS

| | | | |
|---|---|---|---|
| 3,128,590 | 4/1964 | Escursell-Prat | 57/34 R |
| 3,431,719 | 3/1969 | Bell | 57/34 R X |
| 3,486,319 | 12/1969 | Lee, Jr. et al. | 57/34 R |
| 3,628,320 | 12/1971 | Harmon | 57/34 R |
| 3,728,852 | 4/1973 | Anderson et al. | 57/34 R |
| 3,807,155 | 4/1974 | Miyazaki et al. | 57/34 R |
| 3,882,664 | 5/1975 | Cleland | 57/34 R |

*Primary Examiner*—John Petrakes
*Attorney, Agent, or Firm*—Karl F. Ross

[57] ABSTRACT

A thread monitor moving along a bank of upright spindles surrounded by vertically reciprocable track rings engaged by travelers, designed to facilitate the winding of yarns, rovings or other filaments on cops carried by the spindles, includes a suction tube picking up loose ends of ruptured filaments for tying them to fresh oncoming threads. A filament-threading device moving with the thread monitor comprises a gripper with a closable hook, displaceable on the level of the track ring, and a deflector in the form of a transverse roller eccentrically rotatable about a horizontal axis skew to the spindle axis. A loose thread end held under tension by the suction tube extends from the cop around the deflector in a first pass, lying high enough above an upper ring flange to give clearance to the traveler carried by this flange, and then via the closed gripper hook to the suction tube; upon an advance of the gripper from a retracted position to a working position alongside the ring, a second pass of the thread end comes to lie approximately tangentially to the ring flange at a small inclination to its plane whereby the traveler, driven by a circulating air flow originating at a nozzle on the deflector support, embraces this second pass and reengages the ruptured thread. A rotation of the deflector about its axis then elevates the pass so engaged and dislodges the loose thread end from the deflector while the opening of the gripper hook releases this thread end to further aspiration by the suction tube preparatorily to tying.

10 Claims, 6 Drawing Figures

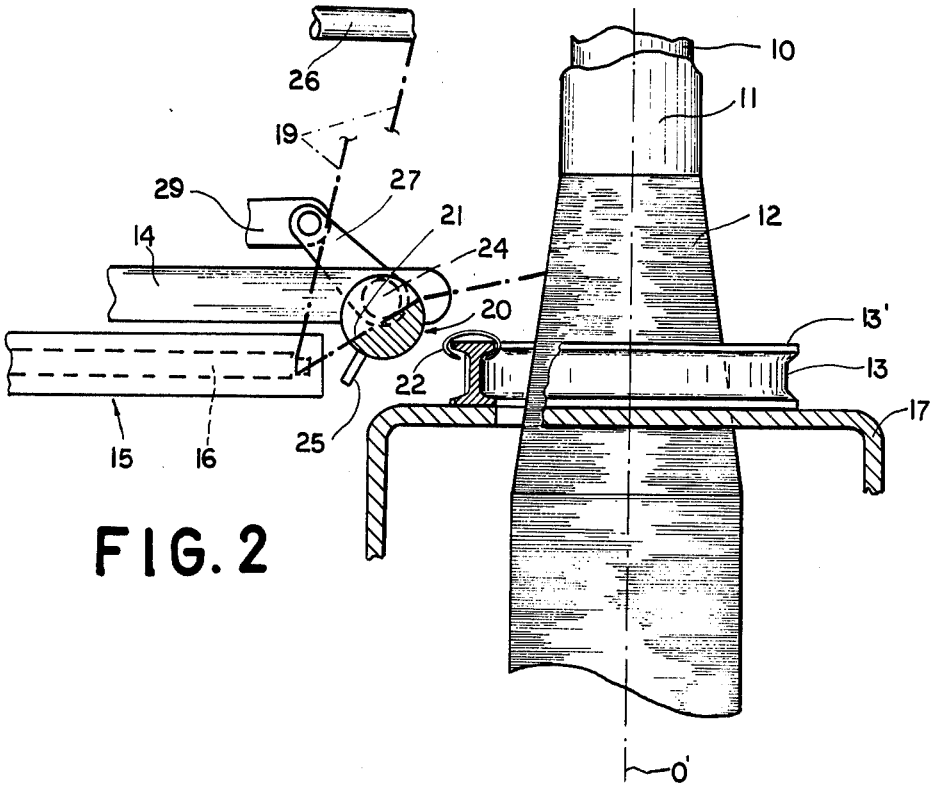
FIG. 2
FIG. 1
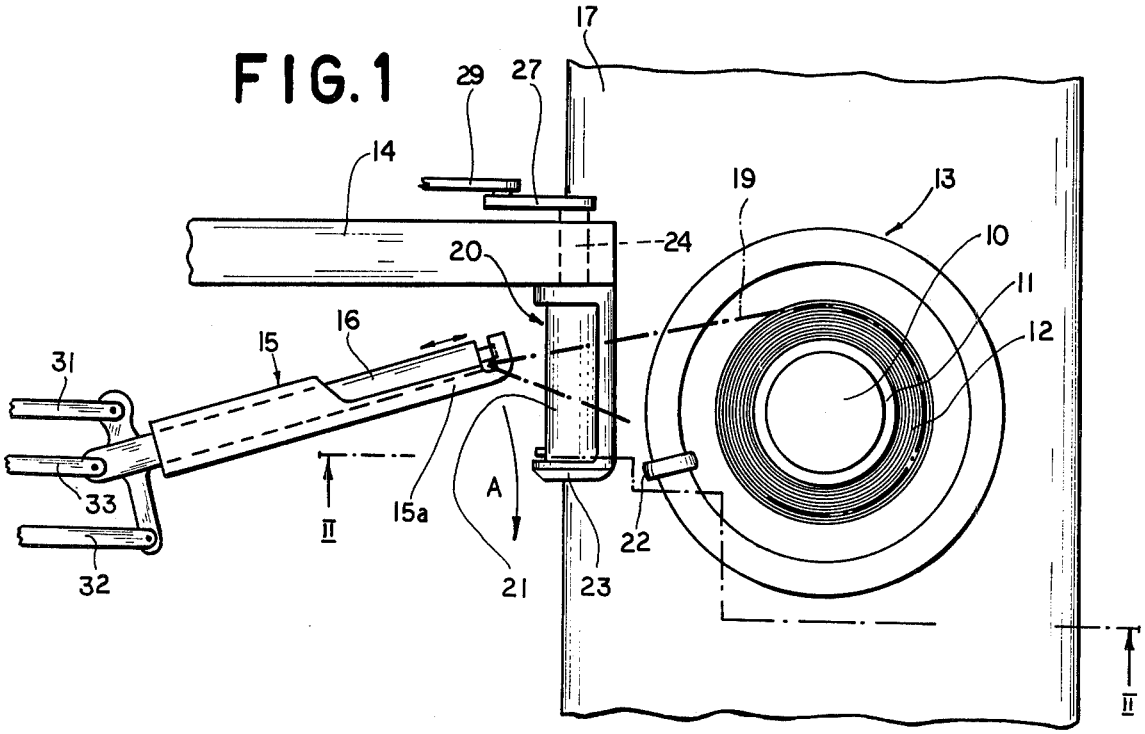

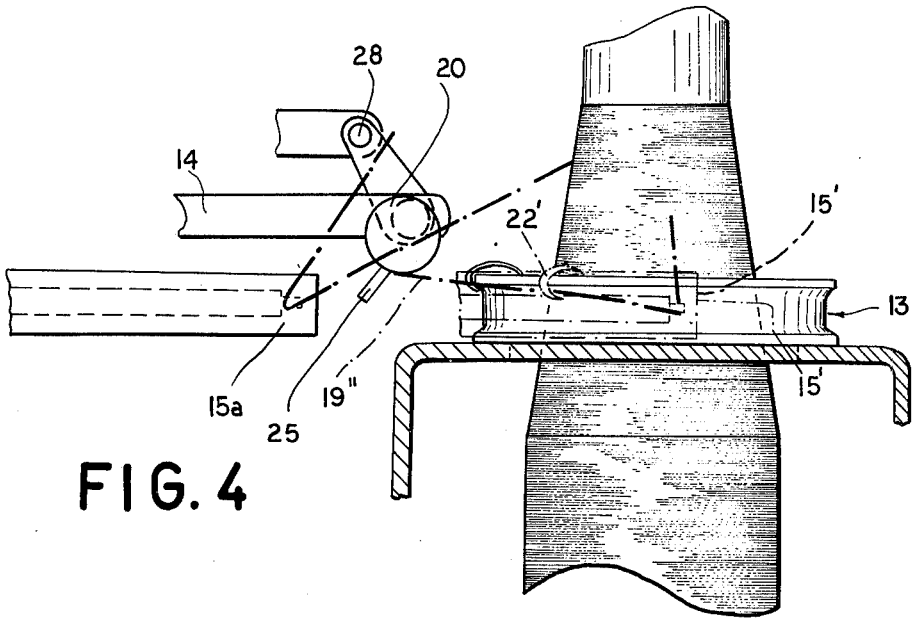
FIG. 4
FIG. 3
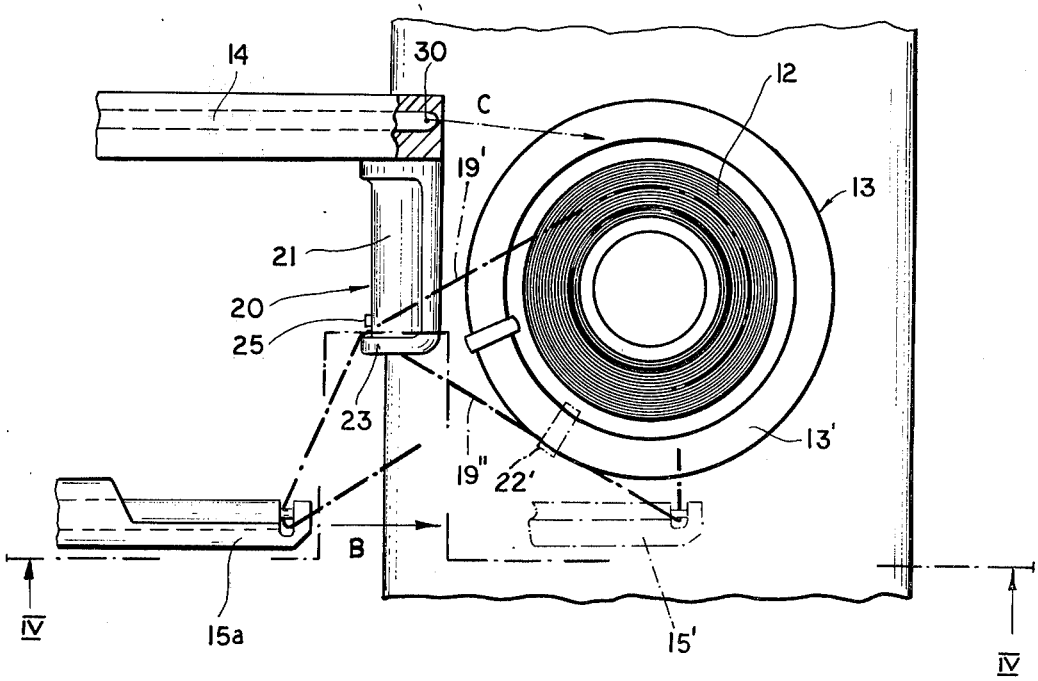

AUTOMATIC THREADING DEVICE FOR FILAMENT WINDING MACHINES

FIELD OF THE INVENTION

Our present invention relates to a thread-winding machine of the type used for the spinning or twisting of filaments such as rovings or yarns, each filament being wound on a bobbin core or cop placed on a rotating, usually upright spindle.

BACKGROUND OF THE INVENTION

Machines of this type generally comprise a large number of winding stations formed by parallel spindles rising from a common bed, each spindle being spacedly surrounded by a coaxial track ring carrying a traveler through which the filament to be wound upon its cop is threaded. The track rings are mounted on a common shelf, or ring bank, which is vertically reciprocable with reference to the spindle bed in order to distribute the turns of the filament as uniformly as possible along the cop surface.

In the operation of such machines, the feeding of the filaments to the several spindles is frequently interrupted by a rupture which may be due to an actual breaking of the thread or to the fact that the thread of an associated supply spool has run out. Since a loose thread end remaining on an incompletely wound and still rotating cop may become entangled with the filaments of adjoining winding stations, it is customary to provide the machines with automatic thread monitors on carriages traveling along the bank of spindles in order to detect the presence of a rupture. These conventional thread monitors automatically arrest any spindle found to have a loose thread end, that end being then picked up by a suction tube and led to a tying mechanism which automatically connects it with a fresh oncoming thread. Before the winding station involved can resume its normal operation, however, it is necessary to reintroduce the previously ruptured thread into the associated traveler.

Systems are already known which automatically carry out this rethreading of a traveler. In these systems, the loose filament end drawn away from the cop by the suction tube is gripped at an intermediate point and bent into two angularly adjoining passes, one of them coming to lie on a flange of the track ring engaged by the traveler while the other pass approaches the ring more or less tangentially so as to cross the path of the traveler driven around the flange by a circulating air stream. It may happen, however, that the traveler finds itself trapped in a dead zone between the two passes, encompassing perhaps a segment of 50° to 80° of the ring periphery, being thus prevented by the first pass from reaching its point of engagement with the second pass. A temporary withdrawal of the thread from the track ring then becomes necessary in order to let the traveler move on whereupon the rethreading operation can be tried anew.

OBJECT OF THE INVENTION

The object of our present invention, therefore, is to provide improved means on a thread monitor for reinserting a loose filament end into a traveler with avoidance of the aforestated problem.

SUMMARY OF THE INVENTION

A thread monitor embodying our invention comprises, in its basically conventional part, pickup means such as the aforementioned suction tube for seizing a loose filament end as well as gripper means for engagement with this loose end at a point between the pickup means and the cop from which that end is drawn.

According to the present improvement, we further provide deflector means extending generally skew to the spindle axis at a location offset from the level of the track ring for intercepting a portion of the loose filament end lying between the cop and the gripper means, thereby dividing that portion into a first and a second pass as described above but with the difference that the first pass is held at a distance from the traveler-carrying ring flange sufficient to give clearance to the traveler. An actuating mechanism advances the previously retracted gripper means substantially at the level of the track ring to position the second pass approximately tangentially adjacent the aforementioned flange at a small angle of relative inclination which enables the traveler, driven by fluid-circulation means, to embrace this second pass whereupon the engaged thread portion is disengaged from both the deflector means and the gripper means by the operation of suitable release means.

According to a more particular feature of our invention, the deflector means comprises a roller with a peripheral recess accommodating the engaged filament portion. The roller has an eccentric shaft rotatably held in a support which may be immovably mounted on a thread-monitor carriage, at a fixed distance from the track ring. The release means comprises a linkage connected with that roller (e.g. by way of its shaft) for rotating same through an angle of, say, 90° to 120° from a first position, in which its peripheral recess is averted from the spindle, into a second position in which that recess faces the spindle. In this latter position the terminal thread portion, still under tension from the pickup means, is pulled off the deflecting roller by way of the traveler in which it is now inserted. The release from the gripper, occurring substantially at the same time, may be effected by the withdrawal of a latch serving for the closure of a thread-engaging hook.

BRIEF DESCRIPTION OF THE DRAWING

The above and other features of our invention will now be described in detail with reference to the accompanying drawing in which:

FIG. 1 is a top view of a station of a filament-winding machine equipped with an automatic threading device according to our invention, shown in a position following the pickup of a loose filament end by a thread monitor;

FIG. 2 is a side-elevational view of the assembly illustrated in FIG. 1;

FIG. 3 is a view similar to FIG. 1, showing the reinsertion of the loose filament end into a traveler;

FIG. 4 is a view similar to FIG. 2 but relating to the position of FIG. 3;

SPECIFIC DESCRIPTION

Figure 6:
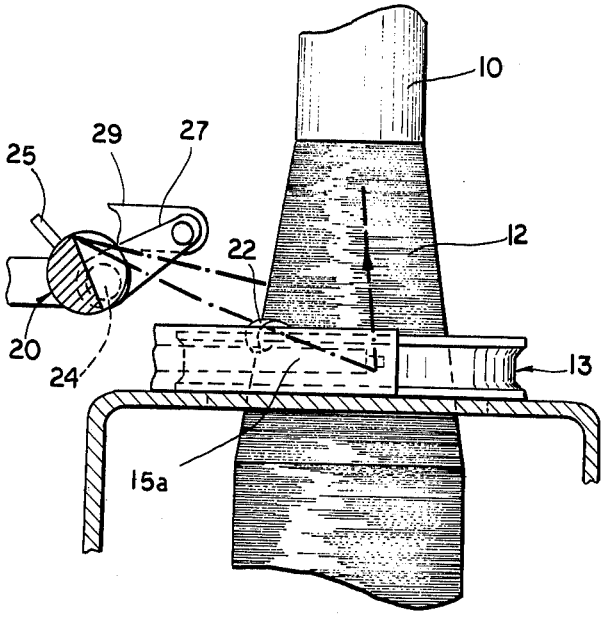
FIG. 6 is a view similar to FIGS. 2 and 4, relating to the position of FIG. 5.

In the drawing we have shown part of a winding station of a basically conventional textile machine for the spinning or twisting of yarn. The station comprises an upright spindle 10 rotatable about its axis O by a nonillustrated motor. A cop 11 fitted on spindle 10 carries an as yet incomplete yarn package 12 and is spacedly surrounded by a track ring 13 on a mounting 17 which is vertically reciprocable with reference to spindle 10. Ring 13 has an upper flange 13' straddled with clearance by the lower ends of a generally C-shaped traveler 22.

A conventional thread monitor, comprising a nonillustrated carriage riding a track rigid with the ring mounting 17, scans the bank of spindles 10 to detect any yarn rupture. This thread monitor includes a suction tube 26, lying well above the level of ring 13, which aspirates the loose end of a thread 19 forming part of yarn package 12; this loose end is drawn to a yarn-tying mechanism (not shown) which connects it with a fresh oncoming thread in a manner known per se and not relevant to the present invention.

The carriage of the thread monitor also supports an elongate gripper 15, which is limitedly swingable and longitudinally displaceable in a horizontal plane at the level of ring 13, as well as an arm 14 disposed at a somewhat higher level and maintained at a fixed distance from ring mounting 17 and spindle axis O. Gripper 15 terminates in a hook **15*a* which is closable by a latch 16 longitudinally slidable therein. The movements of gripper 15 and latch 16 are controlled by a mechanism schematically represented by a set of links 31, 32 and 33**.

Arm 14 is traversed by an eccentric shaft 24 of a deflecting roller 20, this shaft defining a horizontal pivotal axis skew to the spindle axis O. Roller 20 is formed with a peripheral recess 21 bounded at its outer end by a transverse wall 23; a pin 25 projects radially from the roller in the vicinity of this wall 23 and in a direction away from shaft 24. Roller 20 has two distinct positions, namely a working position shown in FIGS. 1–4 and a disengagement position shown in FIGS. 5 and 6. In the working position, recess 21 is averted from spindle axis O and faces directly away from ring 13; in its disengagement position, offset by somewhat more than 90° from the working position, the recess is turned toward spindle 10 and ring 13. The rotation of the roller between these two positions is effected by a mechanism partly represented by a pair of links 27, 29 articulated to each other at 28.

Arm 14 terminates in a nozzle 30, illustrated in FIG. 3, which is trained upon the annular gap existing between ring 13 and cop 11. Nozzle 30 communicates with a source of air under pressure to generate a circulating air flow within that gap, rotating in a clockwise direction as viewed in FIGS. 1, 3 and 5, upon the opening of a nonillustrated valve. The generation of this air flow and the operations of gripper 15 and deflector 20 are controlled timed relationship, as described hereinafter, by a nonillustrated programmer on the thread-monitor carriage.

In retracted starting positions shown in FIGS. 1 and 2, in which the terminal thread portion 19 has been picked up by suction tube 26, hook **15*a* of gripper 15 has already engaged that thread portion which is positively retained in the hook by latch 16. The thread is pulled away from cop 11 across roller 20, coming to lie within its recess 21 before passing into tube 26 by way of hook 15*a*. Gripper 15, normally parallel to support arm 14, is inclined at this instant toward arm 14 so that its axis is approximately tangent to yarn package 12. The rotation of spindle 10, normally clockwise as viewed in FIGS. 1, 3 and 5, has been briefly reversed by the thread monitor for paying out a sufficient length of thread 19 to enable its entry into tube 26**; the spindle is stationary at the stage here considered.

It will be noted that roller 20 is sufficiently elevated above the level of ring 13 to prevent any contact between thread 19 and flange 13', the spacing of the thread from the flange being wide enough to let the traveler 22 pass freely underneath. This spacing does not change as the gripper 15 is swung clockwise (arrow A, FIG. 1) into the position of FIGS. 3 and 4 in which the thread bends around the end wall 23 of recess 21. Next, as indicated by an arrow B in FIG. 3, the gripper 15 now paralleling the arm 14 is longitudinally advanced into a position 15' shown in phantom lines in which the thread has two passes 19' and 19'' including an acute angle with each other. Pass 19', extending from yarn package 12 to roller 20, still lies high above flange 13' so as not to intercept the traveler 22 if the latter happens to be in the position illustrated in solid lines in FIG. 3, i.e. between two vertical planes which contain the passes 19', 19'' and include an angle of about 50° to 80° with each other. The simultaneous emission of an air stream from nozzle 30, as indicated by an arrow C, drives the traveler from this or any other position on ring 13 into an engagement position 22' illustrated in phantom lines in FIGS. 3 and 4. In the latter position, the traveler embraces the pass 19'' of the thread which is substantially tangent to ring 13 below flange 13' and is inclined at a small angle to the horizontal. If the traveler happens to be already in this engagement position 22' at the instant when hook **15*a* is advanced into its phantom-line position 15' alongside ring 13, thread portion 19''** snaps directly into the traveler from below.

Figure 5:
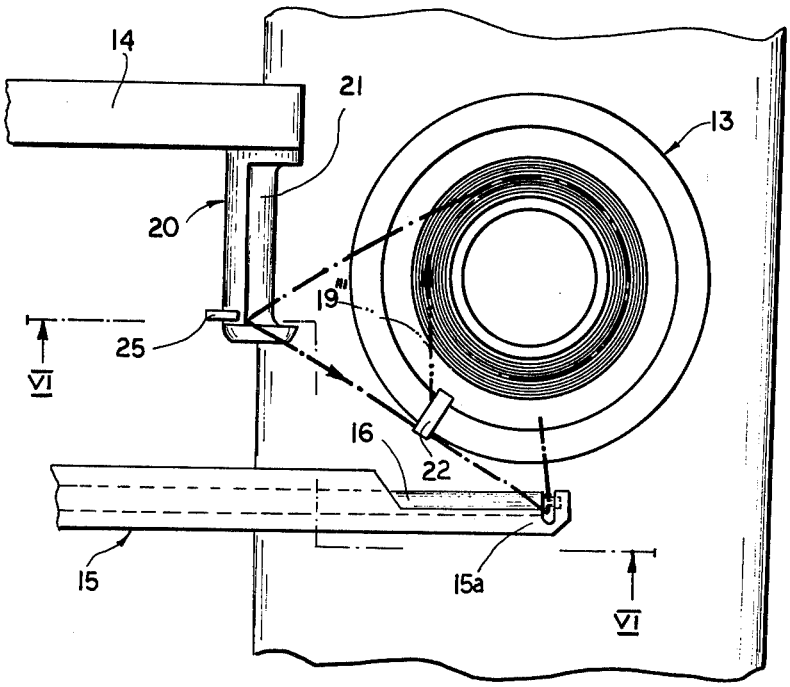
FIG. 5 is another view similar to FIG. 1, illustrating the position of the threading device just before the release of the reinserted filament portion.

Thereafter, with air stream C cut off and gripper 15 still in its advanced position shown in FIGS. 5 and 6, linkage 27–29 is actuated to rotate the roller 20 into its unloading position. With pin 25 insuring that the thread 19 does not remain looped around roller 20, the thread is disengaged from the roller and drawn further into tube 26 which still exerts suction. Finally, the retraction of latch 16 opens the hook **15*a* for a complete release of the thread. If desired, spindle 10** could also be rotated at this time in its normal (clockwise) direction to help tension the thread.

During the operations just described, ring bank 17 and the thread-monitoring carriage with tube 26, gripper 14 and arm 15 may continuously reciprocate vertically so that the other winding stations with unbroken threads may function normally.

Reference may be made to U.S. Pat. Nos. 3,128,590 and 3,486,319 for a description of yarn-tying devices to which our invention is applicable.

We claim:

1. In a thread-winding machine including a substantially vertical spindle rotatable about its axis, a track ring coaxially surrounding said spindle and provided with a mounting reciprocable with reference to said spindle along said axis, and a traveler loosely engaging an upper flange of said ring for guiding a filament to be wound about a cop on said spindle during rotation thereof, the combination therewith of a monitoring device for detecting the presence of a loose end of a ruptured filament on said cop and reinserting said loose end into said traveler, comprising:

pickup means for seizing said loose end and drawing it under tension away from said cop;

gripper means displaceable substantially at the level of said track ring between a retracted position remote from said spindle and an advanced position proximal to said spindle for engaging a portion of said loose end extending between said pickup means and said cop;

deflector means extending generally skew to said axis and transversely to the path of said gripper means at a location above said level for intercepting said portion and dividing same into a first pass extending from said cop to said deflector means above said track ring at a distance from said flange sufficient to give clearance to said traveler and a second pass extending from said deflector means down to said gripper means;

mechanism for displacing said gripper means from said retracted position past said track ring into said advanced position to place said second pass substantially tangentially alongside said track ring adjacent said flange at a small angle of relative inclination enabling said traveler to embrace said second pass;

fluid-circulation means operable to drive said traveler along said flange into engagement with said portion; and release means coupled with said deflector means and said gripper means for disengaging same from said portion.

2. The combination defined in claim 1 wherein said deflector means comprises a roller with a peripheral recess accommodating said portion.

3. The combination defined in claim 2 wherein said roller is provided with a support at a fixed distance from said track ring and with an eccentric shaft rotatably mounting said roller on said support, said release means including a linkage connected with said roller for rotating same from a first position, in which said recess is averted from said spindle, into a second position in which said recess faces said spindle.

4. The combination defined in claim 3 wherein said roller is further provided with a radial projection helping dislodge said portion from said recess in said second position thereof.

5. The combination defined in claim 3 wherein said gripper means comprises a hook closable by a latch, said release means further including a connection for retracting said latch.

6. The combination defined in claim 3 wherein said pickup means comprises a suction tube generally parallel to said gripper means but vertically spaced therefrom.

7. The combination defined in claim 6 wherein said shaft is disposed at a level between those of said gripper means and said suction tube.

8. The combination defined in claim 7 wherein said gripper means, shaft and suction tube are disposed at successively higher levels.

9. The combination defined in claim 3 wherein said fluid-circulation means comprises an air-emitting nozzle on said support.

10. The combination defined in claim 9 wherein said nozzle is trained upon an annular gap between said track ring and said cop.

* * * * *